US007121513B2

(12) United States Patent
Leitner

(10) Patent No.: US 7,121,513 B2
(45) Date of Patent: Oct. 17, 2006

(54) CROSS FROG FOR A SET OF TRACK POINTS, PROVIDED WITH AN END OF POSITION-RETAINING DEVICE

(75) Inventor: Josef Leitner, Weisskirchen (AT)

(73) Assignees: VAE Eisenbahnsysteme GmbH, Zeltweg (AT); VAE GmbH, Vienna (AT)

( * ) Notice: Subject to any disclaimer, the term of this patent is extended or adjusted under 35 U.S.C. 154(b) by 32 days.

(21) Appl. No.: 10/496,180

(22) PCT Filed: Nov. 15, 2002

(86) PCT No.: PCT/AT02/00318

§ 371 (c)(1),
(2), (4) Date: May 20, 2004

(87) PCT Pub. No.: WO03/044280

PCT Pub. Date: May 30, 2003

(65) Prior Publication Data

US 2005/0067535 A1 Mar. 31, 2005

(30) Foreign Application Priority Data

Nov. 23, 2001 (AT) ..... GM909/2001

(51) Int. Cl.
*E01B 7/10* (2006.01)

(52) U.S. Cl. ..... 246/468; 246/276; 246/382; 246/385

(58) Field of Classification Search ..... 246/276, 246/468, 382, 385, 388, 389, 392
See application file for complete search history.

(56) References Cited

U.S. PATENT DOCUMENTS 889,747 A 6/1908 Bell
1,784,211 A * 12/1930 Vissat ..... 246/382

FOREIGN PATENT DOCUMENTS

| | | | |
|---|---|---|---|
| DE | 38 28 921 | * | 3/1990 |
| DE | 295 10 718 U1 | | 1/1996 |
| EP | 1 022 385 A1 | | 7/2000 |
| FR | 2.037.663 | | 12/1970 |
| WO | WO 00/73120 A1 | | 12/2000 |

* cited by examiner

*Primary Examiner*—Mark T. Le
(74) *Attorney, Agent, or Firm*—Chapman and Cutler LLP

(57) ABSTRACT

A rail switch frog (1) includes a movable frog point (5) slidingly guided within a base frame (2), which frog point is movable into abutment on the wing rails (6, 7) and laterally supported in its abutment positions by supporting elements (10) fixed to the base frame (2). An end-position securing device (12) is provided for resiliently pressing the frog point (5) in its abutment position against the wing rail (6, 7) and the supporting elements (10), which end-position securing device is arranged within the space delimited by the base frame (2) and is connected with the base frame (2), or the supporting elements (10), as well as with the frog point (5).

25 Claims, 2 Drawing Sheets

Figure 1:
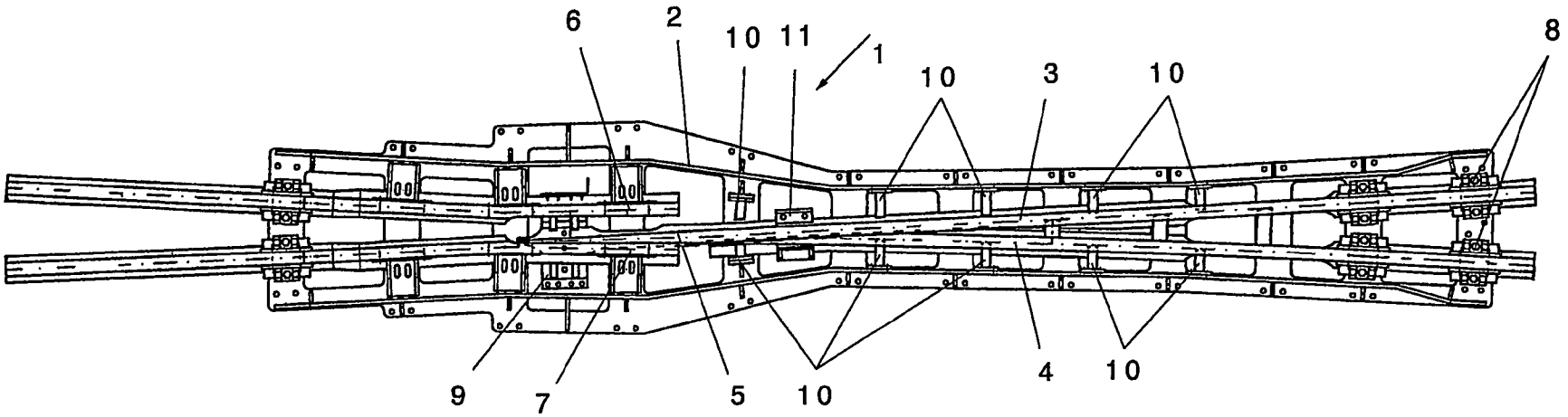

Fig. 2
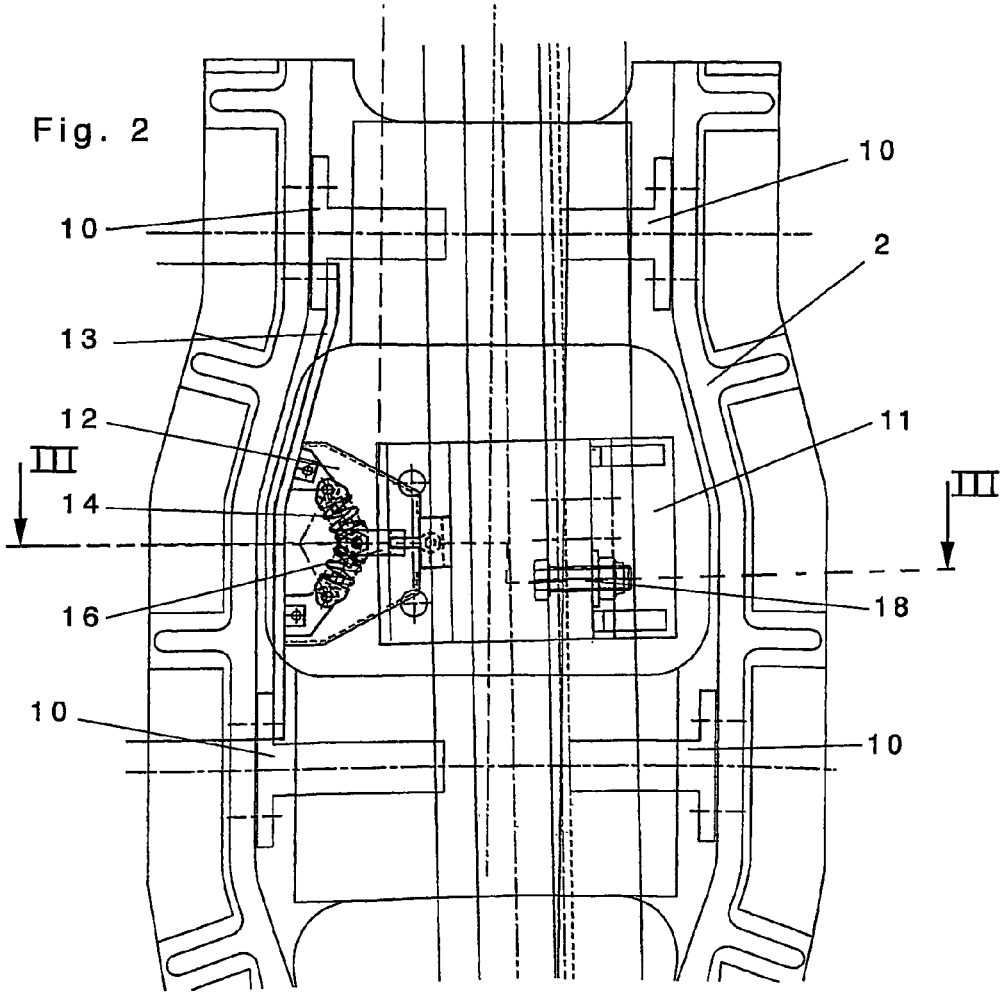
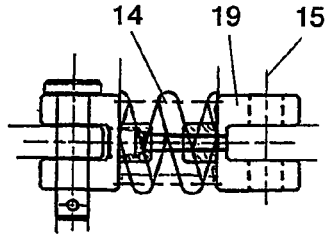
Fig. 4
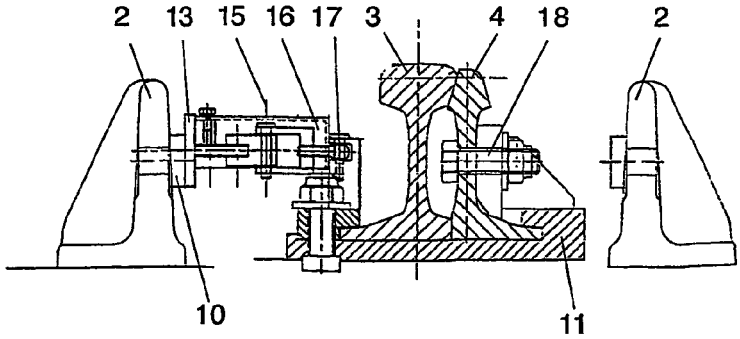
Fig. 3

CROSS FROG FOR A SET OF TRACK POINTS, PROVIDED WITH AN END OF POSITION-RETAINING DEVICE

The invention relates to a rail switch frog including a movable frog point slidingly guided within a base frame, which frog point is movable into abutment on the wing rails and laterally supported in its abutment positions by supporting elements fixed to the base frame.

In the case of frogs including movable frog points, the movable frog point is held fast on the fixing point, on the one hand, and in the planes of actuation and locking, on the other hand, and in the respective abutment positions on the wing rails should each get into abutment on the supporting elements provided for the lateral support of the frog point. Yet, due to the bending behavior of the frog point, no precise abutment on the supporting elements connected with the base frame is, in fact, ensured, and hence no frog point support that takes into account the high loads brought about by the high rolling loads is provided. It would, therefore, be desirable to create a frog in which the frog point is sufficiently secured in the abutment positions.

In the context of switch tongue rails that are capable of being displaced into abutment on a stock rail, switching and/or end-position securing devices ensuring the resilient pressing of the tongue rail at the stock rail have already been known. In those known devices, the switching force is assisted by an additional force after a predetermined switching path. In that case, a force accumulator is initially charged during the displacement of switch parts, whereupon the pressing of the tongue rail into an end position is effected upon exceeding of a dead-center position under a new force output from the force accumulator. The force accumulator is comprised of a pressure spring, said pressure spring being connected, for instance, via angular levers with the respectively driven part or the actuator, respectively, as can, for instance, be taken from AT 379 624. Such angular levers have to be precisely hinged in the respective position, thus requiring a number of hinge points via which the force of the force accumulator is subsequently transmitted to the parts to be reset. A switching and/or end-position securing device of this type is also referred to as a spring rocker. From FR-A-2523537, a switching aid including an integrated hydraulic drive has already become known, wherein spring rockers are formed by two pressure springs which are supported on the housing of the ground box and enter into effect upon exceeding of the respective dead-center positions. Finally, a switching device for a rail switch including stock rails and tongue rails associated therewith has become known from DE 295 10 718 U1 and WO 00/73120 A1, in which the switching device is fixable in one of two end positions via at least one spring element. In those known configurations, the tongue foot is embraced by a connecting element which cooperates with a spring rocker arranged on a fixing plate clamped to the stock rail. In addition, a lever element may be used as an intermediate element to the connecting rod assembly in order to support, and render checkable, the end-of-travel position.

The present invention aims to provide a frog which enables an enhanced lateral support of the frog point in its abutment positions and appropriate securement of the same in its end position as well as its pressing against the supporting elements so as to ensure safe passage. To this end, the frog according to the invention is essentially characterized in that an end-position securing device is provided for resiliently pressing the frog point in its abutment position against the wing rail and the supporting elements, which end-position securing device is arranged within the space delimited by the base frame and is connected with the base frame, or the supporting elements, as well as with the frog point.

By providing an end-position securing device resiliently pressing the frog point in its abutment position against the wing rail and the supporting elements, the frog point in its abutment position is laterally pressed at the supporting elements fixed to the base frame so as to reach a substantially improved support of the same. Otherwise, no sufficient support would be ensured, since the frog point cannot be held precisely in its abutment position over its entire length on account of its bending behavior and its elastic deformation. Due to the fact that the end-position securing device according to the invention is arranged within the space delimited by the base frame and is connected with the base frame, or the supporting elements, as well as with the frog point, a particularly compact configuration will be obtained, which takes into account to the optimum degree the extremely scarce space conditions provided in the region of the frog point. By the arrangement of the end-position securing device according to the invention it is prevented that the end-position securing device, or parts of the end-position securing device, will project beyond the space delimited by the base frame such that no parts of the end-position securing device need be fixed to a holding part arranged below the rail foot, as is known from the prior art in the context of tongue and stock rails. Overall, the optimum arrangement in the region of the frog point is thus ensured, whereby it is also feasible to retrofit into the frog particularly the end-position securing device, since mounting is effected in a simple manner on the base frame or on the supporting elements.

In a preferred manner, the end-position securing device is fixed to a carrying part connecting two neighboring supporting elements. By this configuration, the retrofitting of the end-position securing device is further facilitated, since the end-position securing device can be fixed to the carrying part already in advance, thus already enabling the precise positioning of the end-position securing device. After this, the carrying part, whose extension in the longitudinal direction of the rail corresponds substantially to the distance provided between two neighboring supporting elements, need only be connected with these neighboring supporting elements, this being feasible in an advantageous manner by means of the already existing screw connection of the supporting elements. On the rail side, the mounting of the end-position securing device can be realized in a preferred manner in that the end-position securing device is connected to a holding part embracing the rail foot of the long point and the rail foot of the short point. Such a holding part connecting the long point with the short point is already present in most cases anyway, so that the coupling of the end-position securing device is feasible with a minimum of additional parts also on the rail side. The holding part embracing the rail foot of the long point and the rail foot of the short point in most cases is connected with the frog point by a pin passing through the rail stem of the long point and the short point, respectively, in the region of their center-of-gravity planes as already known per se, whereby only the relative longitudinal displaceability of the long point relative to the short point will have to be borne in mind. In this preferred configuration, the introduction of force takes place in the region of the center-of-gravity plane of the frog point, and hence in the region of the neutral axis, i.e., approximately in the center of the rail stem, so that the occurrence of tilting moments will be largely prevented. In this context, the configuration in a preferred manner may be further developed such that the rail-side hinge point of the end-position securing device is located in the region of the center-of-gravity plane of the frog point. Overall, the entire end-position securing device is, thus, arranged in the region of the center-of-gravity plane of the frog point such that all of the effective forces are located in one plane.

In a preferred manner, the end-position securing device is designed as a spring rocker, thus providing a particularly compact mode of construction and enabling the securement of both the right-side and the left-side end positions of the frog point by means of a single device.

In the following, the invention will be explained in more detail by way of an exemplary embodiment schematically illustrated in the drawing. Therein, FIG. 1 is the plan view of a rail switch part including a movable frog point and a cast or welded base frame; FIG. 2 is an enlarged detailed view of FIG. 1; FIG. 3 illustrates a section through FIG. 2 along line III—III; and FIG. 4 is a partial view of a spring rocker element.

FIG. 1 depicts a frog 1, whose base frame is denoted by 2. The frog point 5, which is comprised of a long point 3 and a short point 4, can facultatively be displaced or pivoted into abutment on the rigid wing rail 6 or the rigid wing rail 7. The movable frog point 5 is held fast on the fixing point 8, on the one hand, and in the plane of actuation and locking 9, on the other hand. Supporting elements 10 fixed to the base frame 2 are provided to enable the precise positioning of the movable frog point 5 in the respective end positions. Furthermore, a holding part 11 is apparent, which embraces the rail foot of the long point and the rail foot of the short point and, at the same time, guarantees the required longitudinal displaceability of the short point relative to the long point.

FIG. 2 shows a detailed view of the frog with an end-position securing device 12 arranged in the region of the holding part 11, which end-position securing device is fastened to a carrying part 13 connecting the two neighboring supporting elements 10. From the sectional illustration according to FIG. 3, it is apparent that the end-position securing device 12 is arranged within the space delimited by the base frame 2. The end-position securing device 12 in this case is designed as a spring rocker, comprising two pressure springs 14 connected with the carrying part 13 on the frame-side and mounted to rotate about a common axis 15 on the rail-side and pivotally hinged to the holding part 11 via connecting part 16 and hinge part 17. The holding part 11 is connected with a pin 18 passing through the rail stem of the short point 4 in the region of its center-of-gravity plane. In the main, all of the hinge points of the end-position securing device 12 are located in the region of the center-of-gravity plane of the frog point such that the occurrence of tilting moments will be largely prevented. FIG. 4 finally illustrates a detailed view of the spring rocker, wherein the biasing force of the spring 14 can be adjusted by rotating the stirrup part 19 accordingly.

The invention claimed is:

1. A rail switch frog (1) comprising:

a movable frog point (5) slidingly guided within a cast or welded base frame (2) extending at least over generally the length of the frog point (5), said frog point being movable into abutment on wing rails (6, 7) mounted on the base frame (2) and laterally supported in its abutment positions by supporting elements (10) fixed to said base frame (2), and an end-position securing device (12) for resiliently pressing the frog point (5) in its abutment position against the wing rail (6, 7) and the supporting elements (10), wherein the end-position securing device is arranged within a space delimited by said base frame (2), and is attached to said base frame (2), or the supporting elements (10), as well as to the frog point (5).

2. A frog according to claim 1, wherein the end-position securing device (12) is fixed to a carrying part connecting two neighboring supporting elements (10).

3. A frog according to claim 2, wherein a rail-side hinge point of the end-position securing device (12) is located in a region of a center-of-gravity plane of the frog point (5).

4. A frog according to claim 3, wherein the end-position securing device (12) is a spring rocker.

5. A frog according to claim 2, wherein the end-position securing device (12) on a rail side is connected to a holding part (11) embracing a rail foot of a long point (3) and a rail foot of a short point (4).

6. A frog according to claim 5, wherein the end-position securing device (12) is a spring rocker.

7. A frog according to claim 5, wherein a rail-side hinge point of the end-position securing device (12) is located in a region of a center-of-gravity plane of the frog point (5).

8. A frog according to claim 7, wherein the end-position securing device (12) is a spring rocker.

9. A frog according to claim 2, wherein the end-position securing device (12) is a spring rocker.

10. A frog according to claim 1, wherein the end-position securing device (12) on a rail side is connected to a holding part (11) embracing a rail foot of a long point (3) and a rail foot of a short point (4).

11. A frog according to claim 10, wherein a rail-side hinge point of the end-position securing device (12) is located in a region of a center-of-gravity plane of the frog point (5).

12. A frog according to claim 11, wherein the end-position securing device (12) is a spring rocker.

13. A frog according to claim 10, wherein the end-position securing device (12) is a spring rocker.

14. A frog according to claim 1, wherein a rail-side hinge point of the end-position securing device (12) is located in a region of a center-of-gravity plane of the frog point (5).

15. A frog according to claim 14, wherein the end-position securing device (12) is a spring rocker.

16. A frog according to claim 1, wherein the end-position securing device (12) is a spring rocker.

17. A frog according to claim 16, wherein the end-position securing device (12) is a spring rocker.

18. A rail switch frog (1) comprising:

a movable frog point (5) slidingly guided within a base frame (2), said frog point being movable into abutment on wing rails (6, 7) and laterally supported in its abutment positions by supporting elements (10) fixed to the base frame (2), and an end-position securing device (12) for resiliently pressing the frog point (5) in its abutment position against the wing rail (6, 7) and the supporting elements (10), wherein the end-position securing device is arranged within a space delimited by the base frame (2), and is connected with the base frame (2), or the supporting elements (10), as well as with the frog point (5), wherein the end-position securing device (12) on a rail side is connected to a holding part (11) embracing a rail foot of a long point (3) and a rail foot of a short point (4), and wherein the holding part (11) embracing the rail foot of the long point (3) and the rail foot of the short point (4) is connected with the frog point (5) by a pin (18) passing through a rail stem of the long point and the short point (3, 4), respectively, in a region of center-of-gravity planes of the long point and the short point (3, 4).

19. A frog according to claim 18, wherein a rail-side hinge point of the end-position securing device (12) is located in a region of a center-of-gravity plane of the frog point (5).

20. A frog according to claim 19, wherein the end-position securing device (12) is a spring rocker.

21. A frog according to claim 18, wherein the end-position securing device (12) is a spring rocker.

22. A rail switch frog (1) comprising:

a movable frog point (5) slidingly guided within a base frame (2), said frog point being movable into abutment on wing rails (6, 7) and laterally supported in its abutment positions by supporting elements (10) fixed to the base frame (2), and an end-position securing device (12) for resiliently pressing the frog point (5) in its abutment position against the wing rail (6, 7) and the supporting elements (10), wherein the end-position securing device is arranged within a space delimited by the base frame (2), and is connected with the base frame (2), or the supporting elements (10), as well as with the frog point (5), wherein the end-position securing device (12) is fixed to a carrying part connecting two neighboring supporting elements (10), wherein the end-position securing device (12) on a rail side is connected to a holding part (11) embracing a rail foot of a long point (3) and a rail foot of a short point (4), and wherein the holding part (11) embracing the rail foot of the long point (3) and the rail foot of the short point (4) is connected with the frog point (5) by a pin (18) passing through a rail stem of the long point and the short point (3, 4), respectively, in a region of center-of-gravity planes of the long point and the short point (3, 4).

23. A frog according to claim 22, wherein the end-position securing device (12) is a spring rocker.

24. A frog according to claim 22, wherein a rail-side hinge point of the end-position securing device (12) is located in a region of a center-of-gravity plane of the frog point (5).

25. A frog according to claim 24, wherein the end-position securing device (12) is a spring rocker.

* * * * *